United States Patent [19]

Patel

[11] 3,941,276

[45] Mar. 2, 1976

[54] PULL TAB ANTI-ROTATION MOUNTING

[75] Inventor: Anilkumar U. Patel, Summit, Ill.

[73] Assignee: Continental Can Company, Inc., New York, N.Y.

[22] Filed: Nov. 20, 1974

[21] Appl. No.: 525,427

[52] U.S. Cl. ..... 220/270

[51] Int. Cl.[2] ..... B65D 41/32

[58] Field of Search ..... 220/270–274

[56] References Cited

UNITED STATES PATENTS 3,780,902 12/1973 Holc et al. ..... 220/270

*Primary Examiner*—George T. Hall

*Attorney, Agent, or Firm*—John J. Kowalik; Joseph E. Kerwin; William A. Dittmann

[57] ABSTRACT

An improved pull tab mounting arrangement for an easy open end closure member, characterized by the provision of improved pull tab positioning means for maintaining the pull tab in a desired orientation relative to the flap-defining score line. Two protrusions formed in the closure end panel prevent rotational displacement of the tab about the attachment rivet resulting from contact with the knock out pad during the filling and seaming operations or from improper handling subsequent to filling. The protrusions, which are symetrically disposed with relation to an end panel chord drawn along the axis of the flap, serve as anti-rotation abutments and may further serve as spacing means to prevent contact between the tab and the knockout pad. The protrusions may be disposed abutting the tab legs, interior and tangent to the circle of the interior of the tab ring or beneath the ring itself. In the last case, the ring is supported on the protrusions, which are nested within the channel formed by the inner and outer curls of the ring, the outer curl projecting into a notch formed in the walls of the protrusions.

10 Claims, 6 Drawing Figures

PULL TAB ANTI-ROTATION MOUNTING

SUMMARY OF THE INVENTION

As is well known, use of the two-piece cans necessitates the fastening of the end closure after the cans have been filled. Current high speed filling and seaming equipment tends to impart a rotational displacement to the tab ring of self-opening end closures resulting from contact between the equipment knockout pad and the tab ring. Such a displacement, which may also be caused by improper handling of the can subsequent to attachment of the end closure, may result in malfunctioning of the closure when the user attempts to open the can.

Accordingly, the primary object of the present invention is to provide an improved self-opening end closure wherein the tab ring will consistently resist rotational displacement during both end closure attachment and subsequent handling.

This is accomplished by providing a mounting arrangement in which paired protrusions formed in the end panel restrain the tab ring against rotation.

It is a further object of one embodiment of the invention to facilitate grasping of the tab ring by the user.

This is accomplished by providing a mounting arrangement in which the tab ring is maintained in spaced relation with the end panel by anti-rotation protrusions beneath the tab.

It is another object of the invention to provide an inexpensive, easily manufactured anti-rotation device on the end panel which co-operates with a conventional tab ring.

With the above and other objects in view that will hereinafter appear, the nature of the invention will be more understood by reference to the following description, the claims and the several views illustrated in the accompanying drawings.

DESCRIPTION OF THE FIRST PREFERRED EMBODIMENT (FIGS. 1-2)

Figure 1:
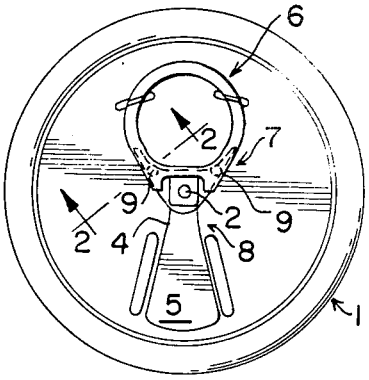
FIG. 1 is a top view of a self-opening end closure which includes one embodiment of the present invention illustrating a plurality of protrusions formed under the tab ring.
Figure 2:
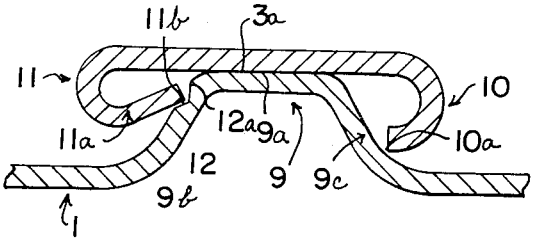
FIG. 2 is an enlarged fragmentary sectional view taken generally along line 2—2 of FIG. 1.

FIGS. 1 and 2 illustrate a self-opening end closure comprising a metal end panel 1, a rivet 2 integrally formed in said end panel 1 and a metal pull tab 3 rotatably attached to said end panel 1 by said rivet 2. A score line 4 is formed in the end panel 1 and defines an opening flap 5 therein.

The tab 3 comprises a finger ring portion 6, an intermediate portion 7 and a nose portion 8.

Two frusto-conical outwardly projecting protrusions 9 are formed in the end panel 1 beneath the intermediate portion 7, said protrusions 9 being symetrically disposed with relation to an end panel chord drawn along the axis of the flap 5. The lower surface 3*a* of the tab 3 is supported on the flat top surface 9*a* of the protrusions 9, thus maintaining said tab 3 in spaced relation with the end panel 1.

The intermediate portion 7 is formed with a substantially U-shaped inner curl 10 and a substantially C-shaped outer curl 11. The outer curl 11 has a straight, upwardly pointing portion 11*a* with a square corner 11*b*. During the staking operation wherein the tab 3 is attached to the end panel 1, the tab 3 is forced downwardly onto the end panel 1, causing the corner 11*b* of the outer curl 11 to form notches 12 in the outer sides 9*b* of the protrusions 9. Any attempt to rotate the tab 3 will result in the corner 11*b* of the outer curl 11 being forced into the vertical surface 12*a* of the notch 12 in one of the protrusions 9, while the corner 10*a* of inner curl 10 is forced into the inner side 9*c* of the other protrusion 9, thereby interlocking the tab 3 and the protrusions 9. The inward slope of the protrusion sides 9*b* and 9*c* and the vertical sides 12*a* of the notches 12 insure that movement of the tab 3 perpendicular to the plane of the end panel 1; as in lifting the tab 3 to break the score line 4, is unrestrained.

DESCRIPTION OF THE SECOND PREFERRED EMBODIMENT (FIGS. 3–4)

Figure 3:
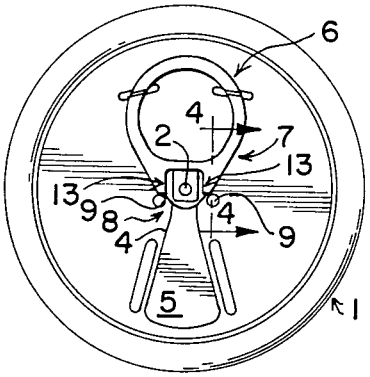
FIG. 3 is a top view of a self-opening end closure illustrating another embodiment of the invention.
Figure 4:
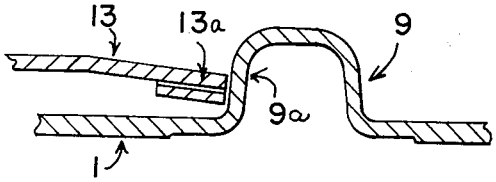
FIG. 4 is an enlarged fragmentary sectional view taken generally along line 4—4 of FIG. 3.

FIGS. 3 and 4 illustrate a self-opening end closure similar to that shown in FIGS. 1 and 2. Identical numbers are used to denote identical parts.

In this embodiment, two sphero-cylindrical protrusions 9, symetrically disposed as hereinbefore described, are formed in the end panel 1 abutting the double folded edges 13*a* of the tab legs 13 in the nose portion 8 of the tab 3. The tab legs 13 have a slight downward inclination which, coupled with the perpendicularity of the protrusion sides 9*a*, insures that the tab legs 13 will not ride up and over the protrusions 9, but rather, that the protrusions 9 will effectively block rotation of the tab 3 through engagement with the tab legs while not restraining lifting of the tab 3. The underside of the end panel 1 beneath the protrusions 9 may be coined to achieve greater protrusion height.

DESCRIPTION OF THE THIRD PREFERRED EMBODIMENT (FIGS. 5-6)

Figure 5:
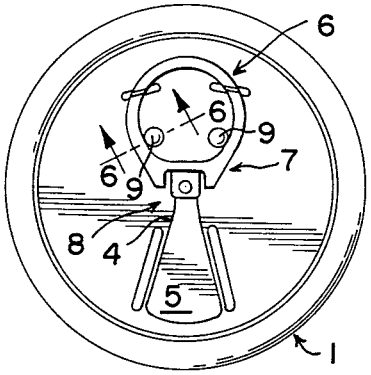
FIG. 5 is a top view of a self-opening end closure which shows still another embodiment of the invention.
Figure 6:
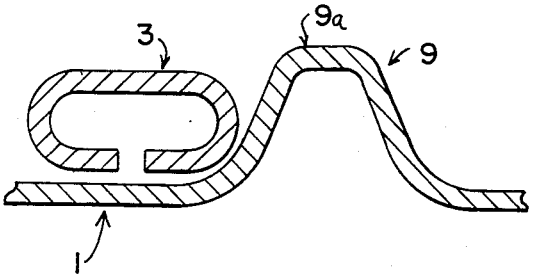
FIG. 6 is an enlarged fragmentary sectional view taken generally along line 6—6 of FIG. 5.

FIGS. 5 and 6 illustrate a self-opening end closure similar to that shown in FIGS. 1 and 2. Identical numbers are used to denote identical parts.

In this embodiment, two frusto-conical protrusions 9 symetrically disposed as hereinbefore described, are formed in the end panel 1 interior and tangent to the circle of the finger ring portion 6 of the tab 3. The protrusions 9 are of a height such that the protrusion tops 9*a* are above the plane of the upper surface of the tab 3. The protrusions 9 thus prevent contact between the knockout pad and the tab 3 and further serve as anti-rotation abutments preventing rotational displacement of the tab 3 due to improper handling of the container subsequent to filling and seaming while not restraining lifting of the tab 3.

While several preferred forms and arrangements of parts have been shown in illustrating the invention, it is to be clearly understood that various changes in details and arrangement of parts may be made without departing from the scope and spirit of the claims appended hereto.

I claim:

1. A tab ring anti-rotation structure for use on a self-opening end closure, said end closure comprising an end panel having an opening flap therein and a pull tab rotatably attached to said end panel, said anti-rotation structure comprising a plurality of protrusions, each of said protrusions comprising a sidewall and a top formed in said end panel and disposed in symmetric relation to a chord of said end panel drawn along the axis of said flap, said protrusions co-operating with said tab parallel to the plane of said end panel, said sidewalls being substantially linear and inclined at a non-locking angle relative to said tab whereby movement of said tab perpendicular to said end panel to open said closure is unrestricted.

2. An anti-rotation structure as described in claim 1, wherein said panel comprises integral rivet means and said pull tab is attached to said end panel by said rivet means.

3. An anti-rotation structure as described in claim 2, wherein said protrusions are frusto-conical in shape.

4. An anti-rotation structure as described in claim 3, wherein said pull tab has a top and two depending side curls forming a channel, and said protrusions are located beneath said pull tab with said channel.

5. A tab ring anti-rotation structure for use on a self-opening end closure, said end closure comprising an end panel having an opening flap therein and a pull tab rotatably attached to said end panel, said end panel comprising integral rivet means and said pull tab being attached to said end panel by said rivet means, said pull tab further having a top and two depending side curls forming a channel, said anti-rotation structure comprising a plurality of protrusions formed in said end panel and disposed in symmetric relation to a chord of said end panel drawn along the axis of said flap, said protrusions being frusto-conical in shape and being located beneath said pull tab within said channel, said protrusions further having walls with notches formed therein and one of said curls projecting within said notches, whereby said protrusions engage said tab in the plane of said end panel while movement of said tab perpendicular to said end panel is unrestricted.

6. An anti-rotation structure as described in claim 4, wherein said pull tab is supported by said protrusions in spaced relation.

7. An anti-rotation structure as described in claim 2, wherein said tab comprises legs and said protrusions are located on either side of and adjacent to the rivet means and abut said legs.

8. An anti-rotation structure as described in claim 7, wherein said protrusions are sphero-cylindrical in shape.

9. An anti-rotation structure as described in claim 7, wherein said legs are inclined panelwardly.

10. An anti-rotation structure as described in claim 2, wherein said protrusions extend above the plane of the top of said pull tab.

* * * * *